United States Patent [19]

Mann

[11] 4,319,753

[45] Mar. 16, 1982

[54] GOLF BALL TEEING MACHINE

[76] Inventor: James H. Mann, 2389 Brown Bark Dr., Dayton, Ohio 45431

[21] Appl. No.: 889,733

[22] Filed: Mar. 24, 1978

Related U.S. Application Data

[63] Continuation-in-part of Ser. No. 714,952, Aug. 16, 1976, abandoned.

[51] Int. Cl.[2] ..... A63H 57/00

[52] U.S. Cl. ..... 273/201

[58] Field of Search ..... 273/201, 202, 33

[56] References Cited

U.S. PATENT DOCUMENTS

| | | | |
|---|---|---|---|
| 2,295,599 | 9/1942 | Mozel | 273/201 |
| 3,448,985 | 6/1969 | Scott | 273/201 |
| 3,738,663 | 6/1973 | Gentiluomo | 273/201 |
| 3,778,067 | 12/1973 | Gentiluomo | 273/201 |

FOREIGN PATENT DOCUMENTS

| | | | |
|---|---|---|---|
| 525751 | 2/1956 | Canada | 273/201 |

*Primary Examiner*—Richard C. Pinkham
*Assistant Examiner*—T. Brown
*Attorney, Agent, or Firm*—Biebel, French & Nauman

[57] ABSTRACT

An automated golf practice tee which is a totally self-contained unit which includes a ball storage hopper (12) and the means (13 and 15) whereby a ball is dispensed from the hopper and moved into position on the tee. It features the capability to preselect any desired tee height ranging from a simulated fairway position, through five intermediate levels, up to an including one and one-half inches. It will repetitively maintain the selected tee height through successive cycles until the golfer himself selects another position. The said unit also features a cycle time of less than ten seconds between the time one ball is hit and the next one is in position. The device is primarily designed for underground installation at outdoor driving ranges, thus it is fabricated of weather resistant materials and provided with moisture barriers. It may, however, also be used at indoor ranges or residences.

7 Claims, 23 Drawing Figures

GOLF BALL TEEING MACHINE

CROSS REFERENCE TO RELATED APPLICATION

This application is a continuation-in-part of application Ser. No. 714,952 filed Aug. 16, 1976 (now abandoned).

BACKGROUND OF THE INVENTION

The device of the present invention is an automated golf practice tee designed for underground installation at golf ranges or possible home use. The ease and cost of fabrication, maintainability, and operational reliability under normal outdoor conditions, were some of the design considerations. The primary objectives are to eliminate the need for a practicing golfer to tee a golf ball between each practice shot, to provide a choice of tee heights, and to establish the capability for more and better practice in a shorter period of time. Achieving these objectives would provide several significant advantages for both the practicing golfers and the range owners.

Proper stance is an important aspect of hitting a golf ball accurately. Currently, a practicing golfer must break both his stance and more importantly, his concentration to tee another ball. The device of the present invention would permit a golfer to experiment with different stances for the varying types of golf shots and to sustain the stance best suited to himself.

On the tee, how high to tee a golf ball is a matter of the type of golf shot desired, the golf club being used, and the particular choice of the individual. The choice usually varies from golfer to golfer. At the present time, the practicing golfer has only one of two choices at an outdoor driving range; even less at an indoor one. He may use either the mats with their fixed tee heights (which may or may not meet his needs); or, he may use his own tees off to the sides or in front of the regular stations, provided there is sufficient space and it is practicable to do so. This unit would permit the golfer to select those positions most suited to himself and the type of golf shot he wishes to practice. It provides a range of options from a ball position which emulates a fairway lie, through five intermediate positions, up to the highest practicable level (1.5 inches). Moreover, it will maintain the selected tee height, ball after ball, until the user himself makes another selection.

The bending and stooping necessary to tee from fifty to a hundred practice balls is very tiring. Although it may be considered good exercise, it is better done at another time and place. It is not conductive to a good practice session or subsequent round of golf; especially for the elderly golfers or those with back problems and other physical limitations. Using this system, the golfer can concentrate on his game better, acquire more practice in a shorter period of time, and be much less fatigued while doing so.

When hitting a bucket of practice balls, it normally requires far more time to get a ball ready to hit than it does to actually make the shot and watch its flight. With the device of the present invention, the time required to hit an equivalent number of balls is considerably shortened. From the time one ball is hit, the next one will be ready for the next shot in less than ten seconds. This feature permits a greater turnover of golfers during rush hours and more balls hit in a given period of time. Thus, driving ranges can accommodate more golfers and provide greater opportunities for improved golf practice sessions.

The device of the present invention may also be used as an ordinary practice tee, if the automation feature is not selected or desired by any one individual.

DETAILED DESCRIPTION OF THE PREFERRED EMBODIMENT

As illustrated in the figures, the preferred embodiment of the present invention is an electro-mechanical device consisting essentially of the following:

1. A weather resistant container with special cover.
2. A ball hopper with an agitator.
3. A gear-motor driven system consisting of a belt, pusher attachments, and pulleys, all designed to propel a golf ball up a ramp and onto a special tee.
4. A uniquely designed reversible gear-motor driven lift and lower mechanism which raises the tee and ball to any one of seven selectable positions and then lowers the tee back to its original position for the receipt of another ball, after the first ball is hit.
5. The necessary ball motion guides.
6. A variety of electrical power and micro switches, and other electrical components.
7. And the chassis, frames, supports, and fasteners required to hold it together.

Figure 1:
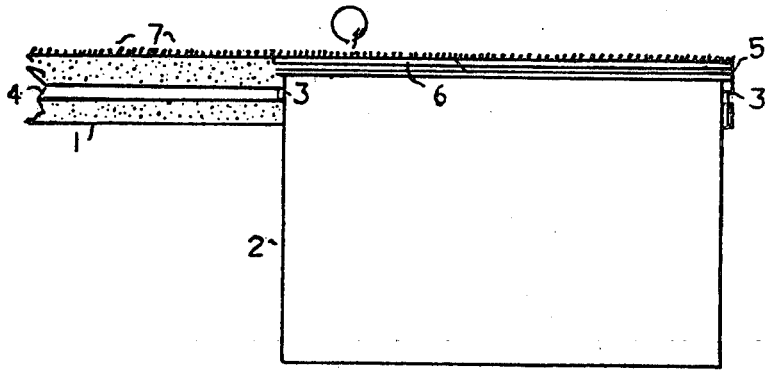
FIG. 1 is a partial cross-sectional elevation view of an installed device of the present invention.

As depicted in FIG. 1, the preferred embodiment is designed for underground installation. Although the concrete slab 1 is not essential to the successful operation of the unit, this is the preferred method of installation. The intent is for the container 2 itself to remain permanently in the ground. The container 2 has installed, one in each end, two electrical connectors 3 which are connected, in turn, to the conduit 4 as shown. One side connects to the electric power supply, when AC power is used, and the other facilitates the interconnection of adjacent units. When batteries or power packs are employed, they provide access for recharging without removal of the units. Needless to say, the container 2 with the connectors 3 and the conduit 4 are fixed into position prior to the pouring of the concrete.

There are two top covers for the container 2. One is the normal cover and access lid 5 used during operation, and the other is a solid cover not shown. The second cover is to be used simply for protection of the container during the periods of time in which the works are removed; for example, during winter months or maintenance. Both covers, as they are used, are affixed to the container 2 with appropriate seals. The concrete slab 1 and the cover 5 are individually surfaced with first a rubber cushion pad 6 and an artificial grass mat 7. Obviously, these additions are to, not only provide for an attractive appearance to the tee area, but also traction for golf shoes and protection for golf clubs.

Figure 2:
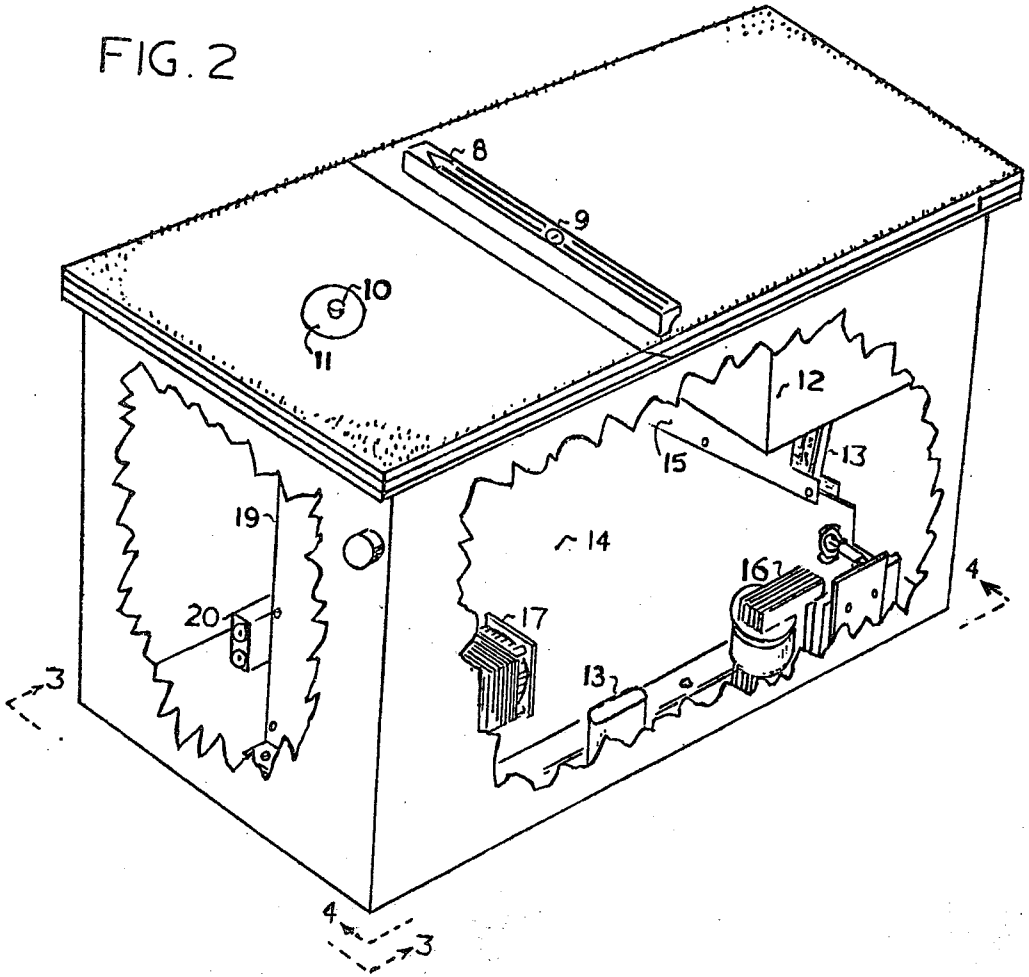
FIG. 2 is a perspective view of the container portion of the preferred embodiment with partial cutouts of the front end and the right side.

The general configuration and layout of the preferred embodiment is as shown in FIGS. 2 through 5. With reference to FIG. 2 first, the access lid handle 8 was deliberately extended to provide both a positional and directional reference. The inlaid arrow serves as a guide for establishing a square, closed, or open stance as desired in addition to showing the general direction the flight of the ball should take. The access lid handle 8 also includes a keylock mechanism 9 to preclude unauthorized use or removal of the machine. In this particular illustration, the unit is shown in a shut-down position. The preferred embodiment is designed such that, when turned off, the tee 10 goes to a full down position and the filler disk 11 goes to a full up position. This feature was added primarily to provide protection for the machine when not in use. More on this feature later.

Mounted inside the container 2 can be seen the hopper 12, the lower ball guide 13, the ramp 14, the ramp hood 15, the ramp motor 16, the lift motor 17, the run capacitor 18 for the lift motor, the lift mechanism 19, and a rectifier 20. As may be discerned, this is essentially an AC configuration. The only exception is a DC magnetic clutch, the function of which will be described later, associated with the lift mechanism 19 and thus requiring the rectifier 20. This discourse addresses this particular configuration, but, it should be noted that to convert to pure DC requires only the addition of batteries or power packs and the substitution of DC gear-motors for the AC ones shown. It would also eliminate the requirement for the capacitor 18 and the rectifier 20. Additional space has been actually allocated within the container to provide for such a conversion.

Figure 3:
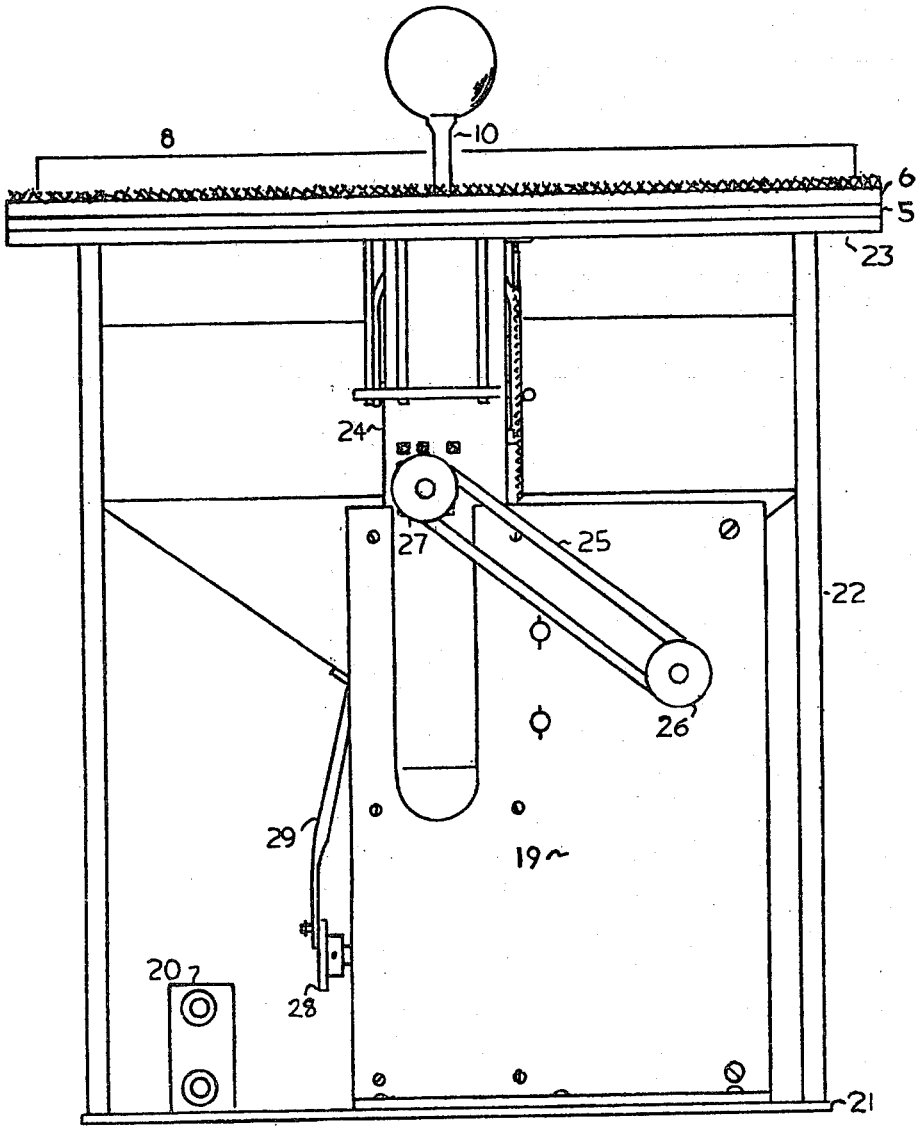
FIG. 3 is a front end elevation view of the preferred embodiment looking from line 3—3 of FIG. 2 with an end cover plate removed.

Now turning to FIG. 3, this drawing illustrates an elevation end view of the unit as it would look in a raised position and a ball sitting on the tee 10. All components are mounted inside a framework consisting of a chassis 21, corner posts 22, and an upper support frame 23. This framework is permanently attacked to the container cover 5, thus the entire assembly lifts out of the container 2 when the cover 5 is disconnected and lifted. This was done to simplify removal for maintenance or storage of the unit.

The primary component of the lift mechanism 19 is the lift rack 24. The most pertinent consideration to note here is that a variance in center point distances occurs, between the two pulleys shown, as the rack 24 is raised and lowered. This variance is accommodated by the use of an elastic bungee type cord 25 between the fixed driver pulley 26 and the driven pulley 27 mounted to the rack 24. A belt with a take-up roller could have been employed, but the method shown is the least costly of the two and is just as effective. The agitator drive wheel 28 and agitator rod 29 are also shown in this drawing.

Figure 4:
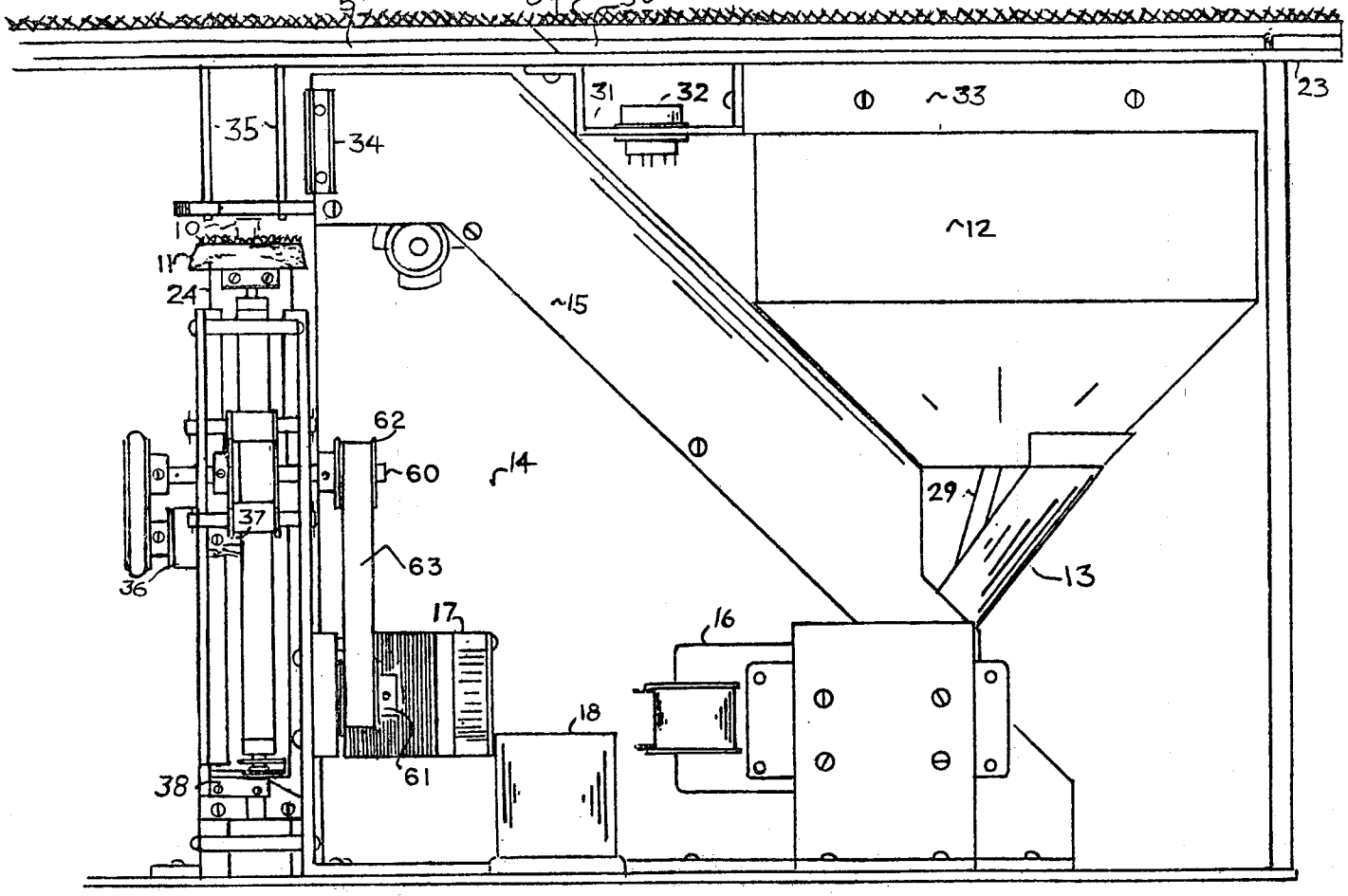
FIG. 4 is an elevation view of the right side of the preferred embodiment looking from line 4—4 of FIG. 2 with a side cover plate removed.

FIG. 4 is an elevation view of the right side of the assembly as it would appear in position to receive a ball. Lifting the access lid 30, which is an inherent hinged part of the container cover 5, discloses the electrical control panel 31 and the mouth of the hopper 12. In addition to the rotary switch 32 shown, the electrical control panel 31 also contains a power on light and a circuit breaker.

The hopper 12 is formed of molded reinforced plastic by preference, but could be fabricated of sheet metal. The upper portion of the hopper 12 is rectangular in shape. The lower part starts out to be rectangular, but is gradually reformed to what is best described as an oblong shaped inverted truncated cone. This design was divised to eliminate the corner creases and thus provide better distribution and flow of golf balls to and through the opening at the bottom. The hopper 12 is mounted to flanges 33 which extend downward from, and is a part of, the upper support frame 23. In this particular configuration, the hopper 12 was designed to hold one hundred golf balls (it actually holds slightly in excess of that number). It can be made larger or smaller to hold more or less balls, but it should be noted that the size of the hopper determines the overall size of the entire assembly in addition to other parts. The figure of 100 golf balls, as a design consideration, was an arbitrary selection based upon the normal practice of driving ranges providing buckets of golf balls in 25, 50, or 100 ball lots, in addition to the studied habits of practicing golfers.

In normal operation, and after the hopper 12 has been filled with golf balls, the ramp motor 16 will start when the rotary switch 32 is moved from "off" to any one of the other seven selectable positions and the rack 24 reaches the full down position. The drive shaft of the ramp motor 16 drives both the agitator 42 and the pulley assembly 39 inside the ramp (Details of the agitator and pulley assembly are provided in subsequent drawings). The agitator rod 29 can be seen through the opening between the lower ball guide 13 and the ramp hood 15. Both the lower ball guide 13 and the ramp hood 15 are also fabricated of molded plastic. The lower ball guide 13 is permanently attached, with a suitable adhesive, to the hopper 12 and the ramp hood 15. There is an open space provided at the rear of the lower ball guide 13 to permit the pusher attachments 40 (not shown here) to pass through. To provide structural strength, the ramp 14 is fabricated of aluminum plate or other suitable metal.

Figure 5:
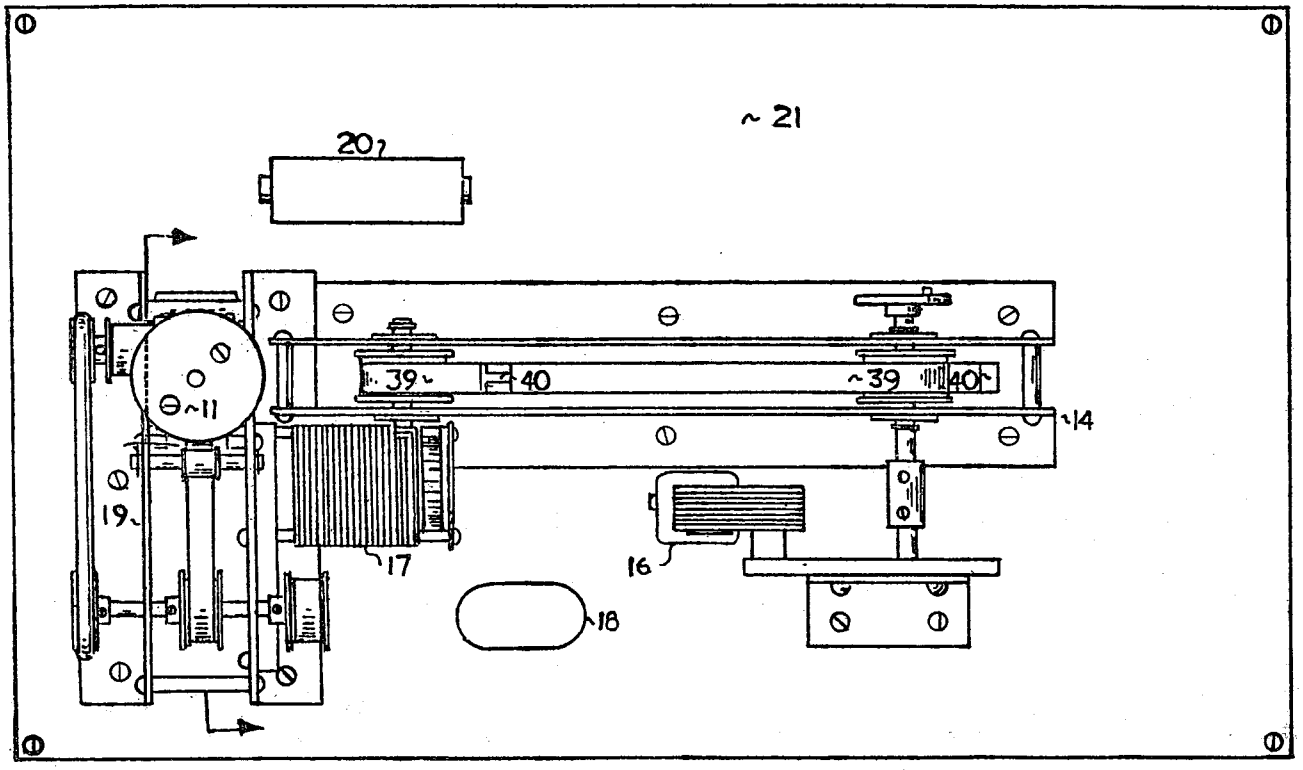
FIG. 5 is a plan view of the chassis layout with the ramp hood removed.

As the balls move from the hopper 12 opening, they stack up on the bottom of the ramp 14 along the lower ball guide 13. A pusher attachment 40 then pushes a single ball from the bottom of the stack and actually rolls it up the two edges of the ramp 14, inside the ramp hood 15. Since the belt of the puller assembly 39, FIG. 5, is below and parallel to the ramp 14 edges, the balls never touch the belt, but are propelled only by the pusher attachments 40. The ramp 14 edges are also plastic covered to provide protection for the balls. When the ball reaches the top of the ramp 14, it is propelled through the small, spring-loaded shut, doors 34, mounted, one on each side, of the opening of the ramp hood 15. The spring loaded doors 34 are there to prevent a ball from inadvertently reentering the opening as the rack 24 lifts. They also form a part of the upper ball guide 35.

Figure 17:
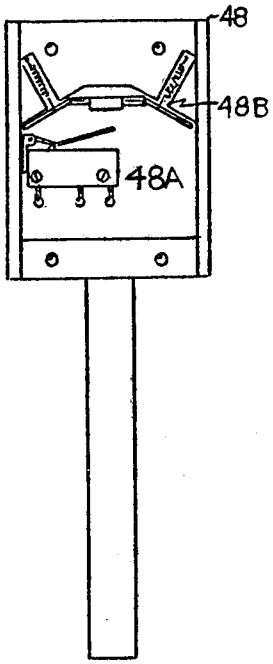
FIG. 17 is an elevation view of the tee switch frame with the cover removed.

The physical weight of the ball, as it comes to reset on the tee 10, actuates a micro switch 48A, FIG. 17, inside the rack 24 (details on page 15, paragraph 2). The micro switch shuts off power to the ramp motor 16 and starts the lift motor 17. Through the interaction of the belt and pulley assemblies and the magnetic clutch 36 shown in FIGS. 4 and 5, and the driven friction roller 47 best depicted in FIG. 14, the lift motor 17 simultaneously raises both the rack 24 and the tee 10, when the clutch 36 is engaged, the tee 10 is raised at a different rate than the rack 24. Since, in this configuration, the total upward travel of the rack 24 is approximately twice that of the tee 10 when being elevated to its highest position, the diameter of the friction roller 47 was established as precisely one-half that of the pitch diameter of the pulleys. Thus, the tee 10, with the ball on top, lifts at the same rate as the rack 24, plus half again that same rate. When the top of the tee 10 reaches a predetermined level above the filler disk 11, as established by the position of the rotary switch 32 (details in later paragraphs), the magnetic clutch 36 disengages and the tee 10 maintains the same relationship with the filler disk 11 throughout that particular cycle. The rack 24 continues upward, however, since the tee 10 always reaches the selected level first. As the filler disk 11 seats into the opening provided in the cover 5, the up-limit switch 37 is actuated by contact with the lower lift bracket 46, which shuts off power to the lift motor 17. It should be indicated that the filler disk 11 is of the same composition and makeup as the container cover 5. It does, however, have slanted edges covered with neoprene or similar material, which effectively seals the opening when the filler disk 11 is seated.

With the actuation of the up-limit switch 37, the ball is now in a position to be hit. In addition, since that same switch temporarily shuts off all power, there are no motor or motion noises to distract the golfer. The opening below the ball is also filled, which might have also proved to be a distraction, if not eliminated.

After the ball is actually hit, the micro switch 48A inside the rack 24 is reactuated. The switch 48A now starts the reverse side of the lift motor 17, and the rack 24 starts down. When the rack 24 going down reaches the same point at which the clutch 36 disengaged going up, the clutch 36 reengages and the tee 10 also moves downward into the rack 24. Thus, when the down limit switch 38 is actuated by contact with the lower lift bracket 46, both the tee 10 and the rack 24 are in their lower most position and ready to receive another ball. The down limit switch 38 shuts off power to the reverse side of the lift motor 17 and starts the ramp motor 16 again. The same cycle is now repeated until all of the balls are gone from the hopper 12.

FIG. 5 is a plan view of the chassis 21 showing only those components mounted directly to the chassis. In addition, the ramp hood 15 has also been removed to better illustrate the pulley assembly 39 inside the ramp 14. Although there is a detailed drawing later, the pusher attachments 40 mentioned earlier can also be seen for the first time. The padding has also been removed from the filler disk 11 to show the details of mounting to the lift rack 24.

As previously established, both the ramp motor 16 and the lift motor 17, in this particular configuration, are AC gear motors. In this instance, they happen to be, respectively, 50 and 20 rpm gear motors. Either one, however, could fall anywhere between the range of 20 to 60 rpm without detriment to operation. It should be further recognized that a single reversible gear motor would have sufficed, but would have required additional clutches. The reason for the two motors is simple. The motors current cost is approximately one fourth that of a clutch. Consequently, the answer is pure economics.

The placement of the majority of the components on one side of the ramp 14 was to provide space for modified versions of the unit. Stated before was the possible additions of batteries or power packs for a DC application. Sufficient space on the opposite side of the ramp 14 was allocated for this purpose. The rectifier 20 location is not pertinent since it would no longer be required in a DC application. Additional space is also provided for a coin box, if a coin initiated operation is desired.

The chassis 21 itself is a dielectric composite board, cut to the proper dimensions, with holes at each corner for attaching the corner posts 22.

Figure 6:
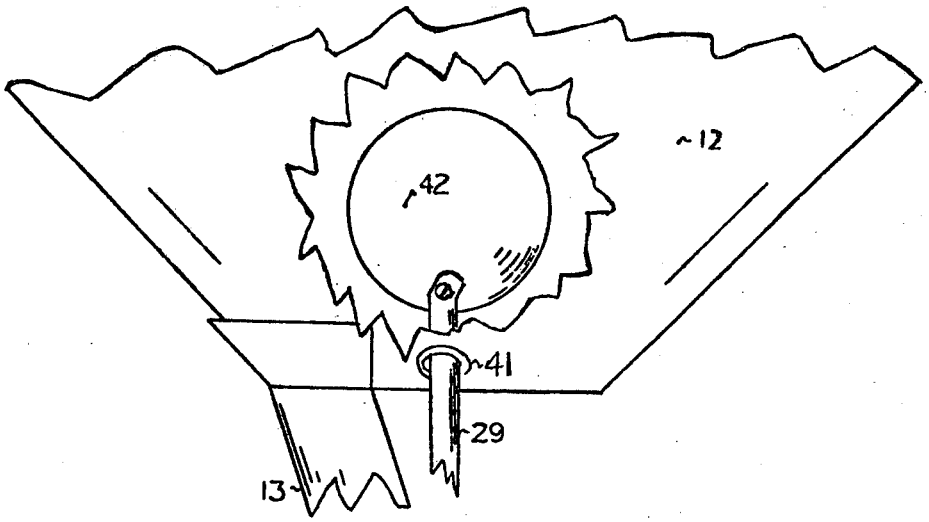
FIG. 6 is a cutaway portion of the left side elevation of the hopper to show the agitator.

To ensure, in as much as possible, a free flow of golf balls through the opening in the bottom of the hopper 12, an agitator inside the hopper was required. Illustrated in FIG. 6 is one such agitator assembly. In this case, the agitator rod 29 is attached to an off-center point of a rotating drive wheel 28, as previously shown in FIG. 3, and driven by the ramp motor 16. The rod 29 extends from the drive wheel 28, through a metal reinforced opening 41 located at the bottom left side of the hopper 12, and permanently affixed to a spherical ball 42. Because of surface compatibility, and thus friction coefficients, in addition to the size, another golf ball was found to be best suited for this purpose. The ball is attached, and the rod 29 shaped, such that the ball extends out into the hopper 12 opening, but does not restrict the passage of balls. Further, the rod 29 is attached to the ball, and the vertical motion constrained, such that no other ball touches the rod 29.

Obviously, the agitator 42 works only when the ramp motor 16 is running. The motor, however, shuts off only when there is a ball sitting on the tee 10. Consequently, the agitator 42 works only when it is indeed needed.

Just as apparent, the agitator 42 moves in both a vertical and lateral motion. The vertical motion is constrained, however, to slightly less than one half the diameter of a golf ball. This restriction prevents other balls from becoming wedged under the agitator 42 as it comes down.

Figure 7:
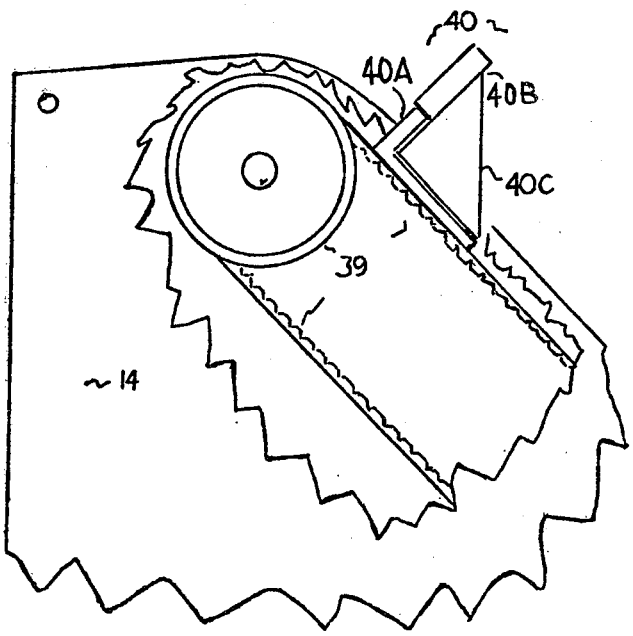
FIG. 7 is a cutaway portion of the ramp to show details of the pusher attachment.

FIG. 7 is a partial right elevation view of the top portion of the ramp 14, with the ramp hood 15 removed, and a cutaway to show primarily a pusher attachment 40. The pusher attachment 40 is also formed of molded reinforced plastic and glued to the belt of the ramp pulley assembly 39. The lower base 40A of the attachment 40, however, is semi-flexible, while the upper cap 40B and the rear support 40C are rigid. The flex was necessary to accommodate the curvature of the pulleys as the attachment 40 rotates around them.

The rigid upper cup 40B is permanently affixed to the top of the base 40A, but the rear support 40C is fastened only to the upper cap 40B as shown. Thus, the attachment 40 is permitted to tilt forward as it goes around the pulleys, but is constrained to the perpendicular while moving upward and propelling a ball.

Attachments 40 are exactly the same width as the belt with a height which extends slightly above the centerline of the golf ball as it rolls up the ramp 14.

Figure 22:
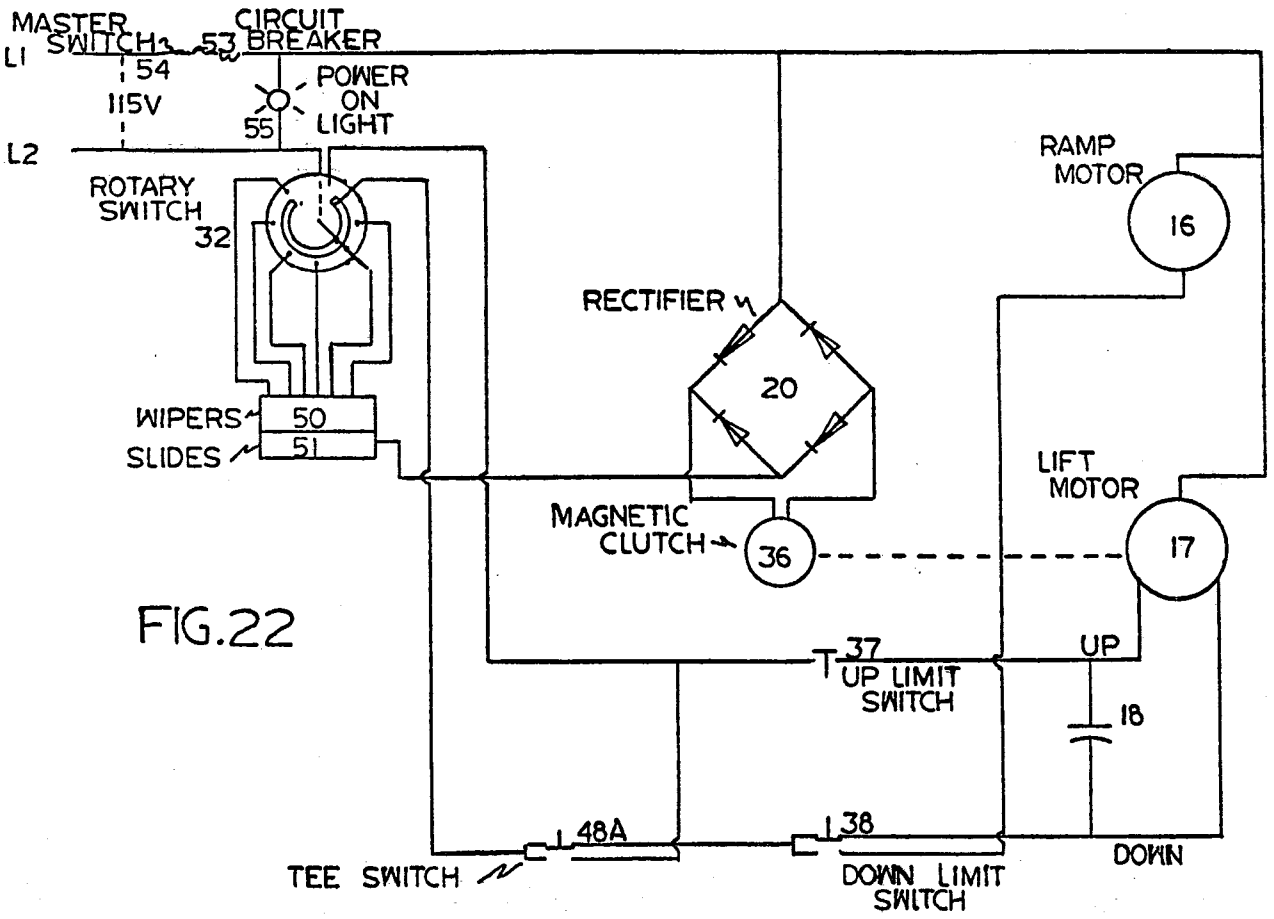
FIG. 22 is the electrical circuitry for operation of the preferred embodiment.

Since the lift mechanism 19, FIGS. 3–5, is the heart of the entire assembly, the remaining drawings, with the exception of the wiring diagram, FIG. 22, are devoted to the individual components and parts of that mechanism. Exclusive of the electrical components, connections, hardware, and support frame, the individual components are again formed of molded reinforced dielectric plastics.

Figure 8:
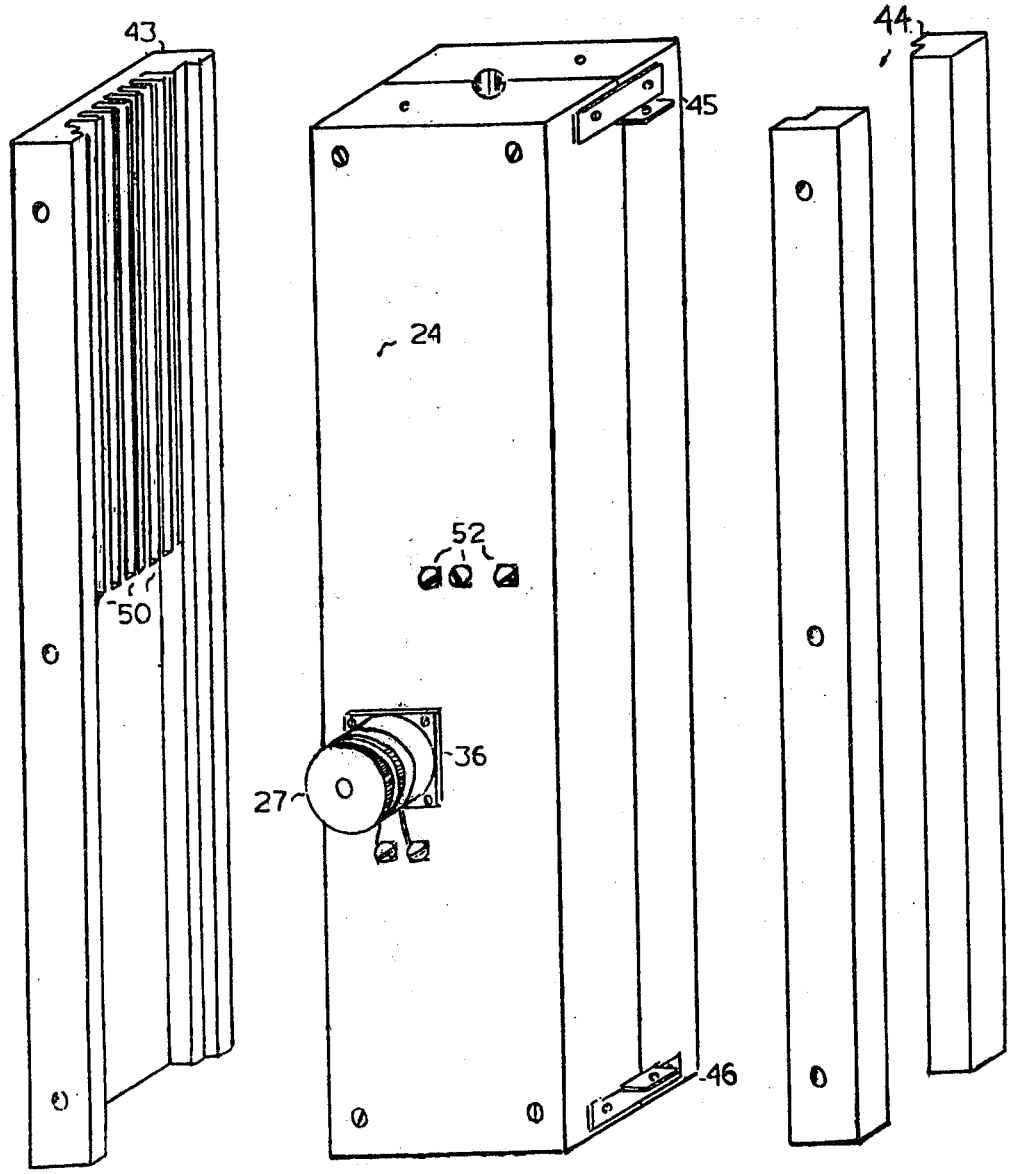
FIG. 8 is a perspective view of the lift rack and lift rack guides removed from their support frame.

FIG. 8 is a perspective of the lift rack 24 and the left and right lift guides, 43 and 44 respectively. In addition, they are removed from the support frame and the filler disk 11 is missing from the top of the rack 24 to provide a better view. In its normal motion, the lift rack 24 slides smoothly up and down on the corner rails of the lift guides 43 and 44. The motive force is supplied by the lift motor 17, FIGS. 3–5, through the pulley and roller assembly shown in FIG. 23. To review, one end of the belt is fastened to the upper lift bracket 45 and extends vertically downward to the roller 57, located approximately one third the way down and mounted within the support frame 19. The belt travels in front and under the roller and extends back horizontally to a driver pulley 58 which is, in turn, mounted on a drive shaft 60 driven, through another pulley assembly by the lift motor 17. The last mentioned pulley assembly is comprised of pulley 61 secured to the motor 17 drive shaft, a pulley 62 secured to drive shaft 60 and a drive belt 63 entrained around pulleys 61 and 62 in order to rotate shaft 60 upon rotation of the drive shaft of motor 17 (See FIG. 4). The belt then passes over, around, and under the driver pulley 58 and back to another roller 59 mounted directly below the first one. It then goes over and in front of the second roller 59 down to the lower lift bracket 46, where it is again fastened. Counter clockwise rotation of the lift motor 17 shaft raises the rack 24 and clockwise rotation lowers it. The up and down limit switches 37 and 38 of FIG. 4 are both mounted, within the support frame 19, such that the lower lift bracket 46 actuates them. The up-limit switch 37 shuts off electrical power to the up side of the reversible lift motor 17 when the rack 24 reaches its uppermost position and the down-limit switch 38 does the same for the down side of the lift motor 17 as the rack 24 returns to its full down position. Thus, as may be seen, the rack 24 travels a fixed and unvarying distance on each and every cycle of operation as dictated by the positioning of the limit switches 37 and 38 while, at the same time, the tee 10 travels a variable distance as determined by exactly when the clutch is engaged or disengaged.

Mounted to the same shaft 60, FIG. 4, which drives the rack 24, is another driver pulley 26, FIG. 3. By means of the elastic cord 25, discussed earlier, this pulley 26 drives another pulley 27 mounted to the front half, or armature assembly, of the magnetic clutch 36 of which the stationary field and coil assembly is mounted directly on the lift rack 24. The rear half, or rotor, of the clutch 36 drives a shaft upon which a friction roller 47 is mounted, FIG. 14, inside the rack 24. Rotation of the friction roller 47 raises and lowers the tee and tee switch frame 48, FIGS. 16–19, also inside the rack 24, FIG. 21. The friction roller 47 only rotates, however, when the magnetic clutch 36 is engaged. When the clutch 36 is not engaged and the rack 24 is in motion, the pulley 26 still drives the pulley 27, but then it, along with the armature assembly of the clutch 36, rotates freely on the shaft and thus there is no motion of the friction roller 47, the tee switch frame 48, nor the tee 10 (See FIG. 21).

Figure 21:
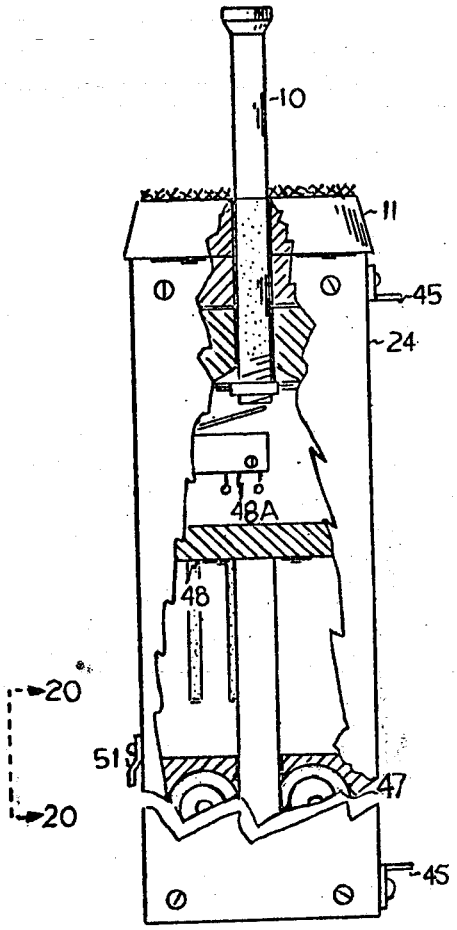
FIG. 21 is a cutaway cross-sectional elevation view of the lift rack with the tee and the tee switch frame in the up position.

In operation, when electrical power is supplied to motor 17 so as to rotate it either clockwise or counterclockwise as needed in order to move the rack 24 up or down as described more specifically below, the pulley 61, FIG. 4, secured to the motor drive shaft rotates and in turn through belt 63 causes rotation of pulley 62 which rotates shaft 60. Secured to shaft 60 are further pulleys 26 and 58. Pulley 26, as mentioned above, drives pulley 27 through the elastic cord 25. Pulley 27 is mounted on the armature assembly of magnetic clutch 36 and the friction roller 47 is mounted on the rotor shaft of magnetic clutch 36. When electrical power is supplied to the magnetic clutch 36 it causes direct coupling therethrough of the armature carrying pulley 27 and the rotor shaft carrying the roller 47. Since the roller 47 engages the lower extension 64 of tee frame 48 (as seen in FIG. 21) it will cause the tee frame 48 to be lifted or lowered within rack 24, depending upon the direction of rotation of motor 17. Since, as mentioned above, it is desirable to raise or lower the tee frame 48 at $1\frac{1}{2}$ times the speed of movement of rack 24, the diameter of roller 47 is sized accordingly so as to translate its rotational movement into the vertical movement of tee frame 48 at the proper speed; in this instance, one-half the pitch diameter of the pulleys as previously indicated. Engaging and disengaging the clutch 36 at the proper times is accomplished by specifically controlling its electrical power supply.

To supply and control electrical power to the magnetic clutch 36, the DC plus and minus leads of the clutch 36 are connected directly to the corresponding leads of the DC side of the rectifier 20, FIG. 22. One AC power lead of the rectifier, however, is routed through a switching arrangement comprised of the wiper cotacts 50, FIG. 10, the sliding contacts 51, FIGS. 20 and 21, and the rotary switch 32, FIG. 22.

Figure 9:
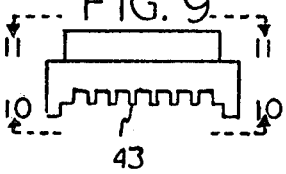
FIG. 9 is a top plan view of the left lift rack guide.

The rotary switch 32 has eight detent positions, the first, or 12 o'clock position, is the "Off" position. Moving clockwise around the periphery of the rotary switch 32 as shown in FIG. 22, the second position of the switch 32 is the zero elevation, or fairway, position of the tee 10 and thus has no connection to the clutch 36. In that position, the clutch 36 is disengaged at all times and the tee 10 never moves from its lower most position. The second position of the rotary switch 32 does, however, energize the remaining circuits. The other six positions, three through eight, of the switch 32 are connected sequentially to the first six positions of a 7-pin male and female quick-connector 49, FIG. 11, to facilitate assembly and disassembly. All seven positions of the female portion of the connector 49 is wired directly to the seven wiper contacts 50 located within the channels provided for them in the lift guide 43, FIGS. 9 and 10. The interconnected sliding contacts 51, mounted on the left side of the rack 24, FIGS. 20 and 21, ride within the channels and form an electrical bridge, at the appropriate times, across the wiper contacts 50, as explained below.

Figure 10:
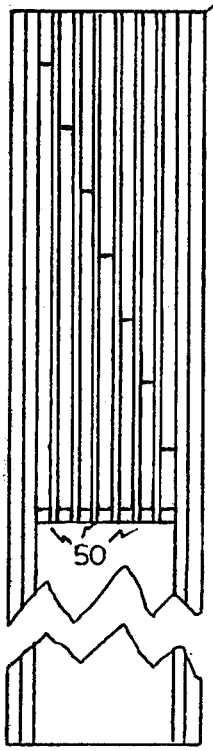
FIG. 10 is a front elevation view of the same guide showing details of the wiper contacts and power disruptors.
Figure 11:
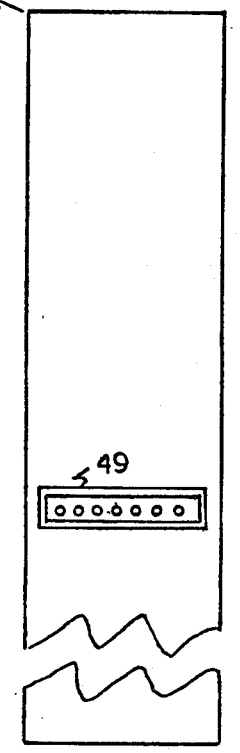
FIG. 11 is a rear elevation view of FIGS. 9 and 10 showing the electrical connector.

With reference to FIG. 10, it can be seen that the wiper contacts 50 are of varying length. The wipers are designed such that the upper terminus of each serves to disrupt power to the clutch 36 at a given tee 10 height above the filler disk 11. Since the rack 24 moves at twice the rate as the tee 10 by design, it requires a half inch length of wiper contact for every quarter inch movement of the tee 10. Thus, the starting from right to left, the shortest wiper corresponds to a quarter inch level rise in the tee 10, as the rack 24 moves up, and, since the first and second positions have already been respectively identified as the "Off" and fairway position of the tee 10, is connected directly through the connector 49 to the third position on the rotary switch 32.

Each succeeding position of the switch 32 corresponds respectively to each wiper contact, with the exception of the last one, and another quarter inch rise in the height of the tee 10. Therefore, there are seven selectable tee 10 heights which range from the simulated fairway position, through five intermediate quarter inch increments, up to and including the 1.5 inch level. The exception mentioned, i.e., the longest wiper and furtherest to the left, provides continuity throughout the motion of the rack 24. This wiper is connected, through the seventh position of the 7-pin connector to the AC lead of the rectifier 20. It also maintains the continuous electrical contact with the interconnected sliding contacts 51 mounted to the rack 24. The sliding contacts 51, however, establish a completed circuit with any one, but only one at a time, of the other six wipers as determined by the position of the rotary switch 32.

Figure 23:
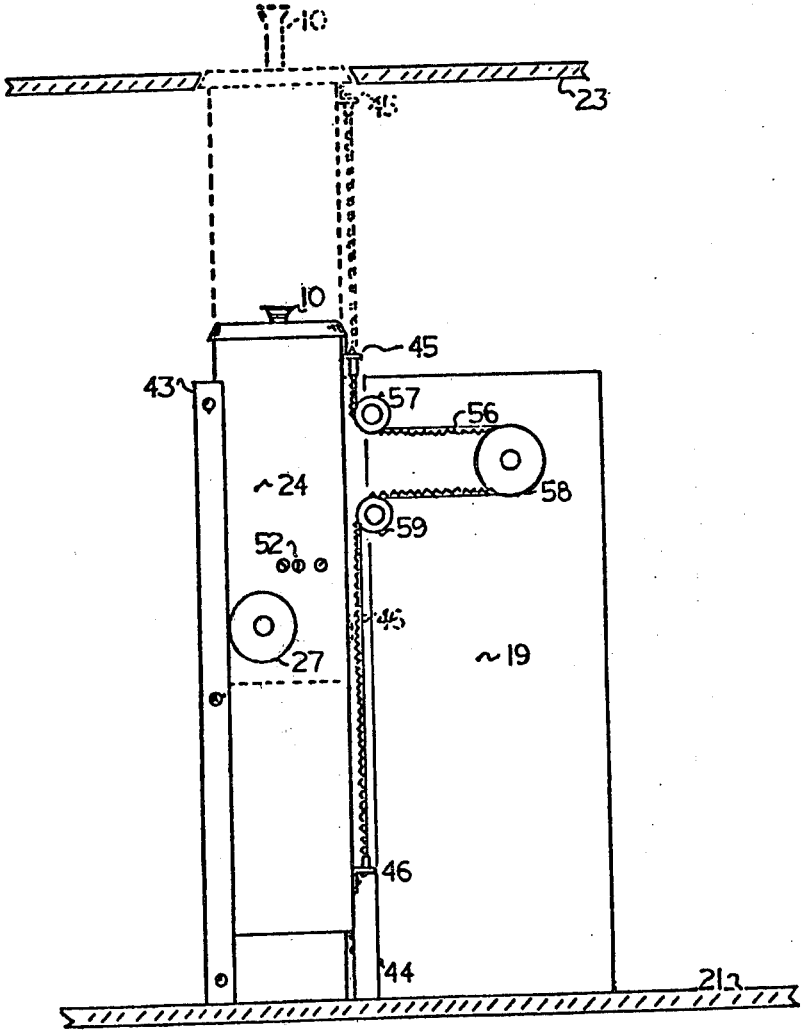
FIG. 23 is a partial view of the lift means depicting the entrainment of the gear belt around the drive rollers and the relative position of the lift rack both before and after elevation.

To better illustrate, perhaps an example would be in order. With momentary reference to the wiring diagram, FIG. 22, which is later discussed in greater detail, it can be seen that the rotary switch 32 is in the fourth position down clockwise from the top. The line emanating from that position is depicted as the second one entering the block diagram of the wiper contacts 50, FIG. 10, and the sliding contacts 51, FIG. 20. It has, however, been previously established that this line is electrically connected to the wiper contact 50, FIG. 10, located in the second channel from the right as observed. Further, the rack 24, FIG. 23, is full down ready to receive a ball. In that position, current flows from $L_1$ through the rectifier 20, through the seventh pin of the 7-pin connector, through the longest wiper on the left of FIG. 10, through the electrical bridge formed by the sliding contacts 51, FIG. 20, through the second wiper, out through the second position of the connector 49, through the fourth position of the rotary switch 32 and out through $L_2$; which completes the circuit thus engaging the magnetic clutch 36. It should be noted that the wiper contacts 50 have nothing whatsoever to do with the actual motion of the rack 24, only with its position. It's only when a golf ball is seated on the tee 10, that both the rack 24 and the tee frame 48, FIG. 21, inside start to lift. As the sliding contacts 51 pass the upper limit of the second wiper, the continuity is broken, the power disrupted to the rectifier 20, and the clutch 36 disengages. The rack 24, however, continues upward until the filler disk 11 seats. At the point where the clutch 36 disengaged, the height of the top of the tee 10 would be one half inch above the filler disk 11. The tee 10 will remain in that position until the ball is hit and the rack 24, going down, reaches the point where the sliding contacts again reaches the upper limit of the second wiper. At that point, the circuit is again completed, the clutch reengaged, and the friction roller 47 starts driving the tee frame 48, FIG. 21, inside the rack 24 down. When the lower limit switch is actuated, both the tee 10 and rack 24 are in their lower most position and ready to receive another ball.

FIGS. 12–15, provide additional details of the rack 24 with the filler disk 11 installed. As shown, the rack 24 consists of two major halves joined together. In addition, there is a rectangular shaped cavity in its center designed to accommodate the motion of the tee 10 and frame 48, the detail of which is also discussed in the following series of drawings.

Figure 12:
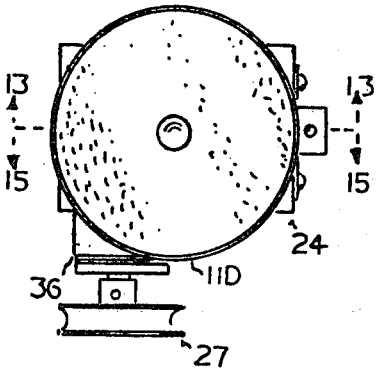
FIG. 12 is a top plan view of the lift rack with the rubber pad and artificial grass removed.
Figure 14:
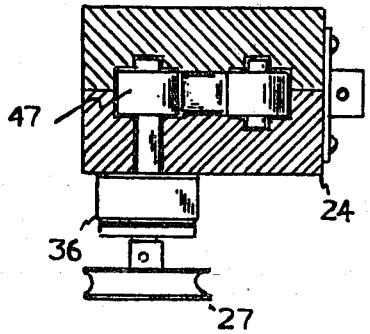
FIG. 14 is a fragmentary cross-sectional view of the lift rack showing additional details and taken on the line 14—14 of FIG. 13.
Figure 13:
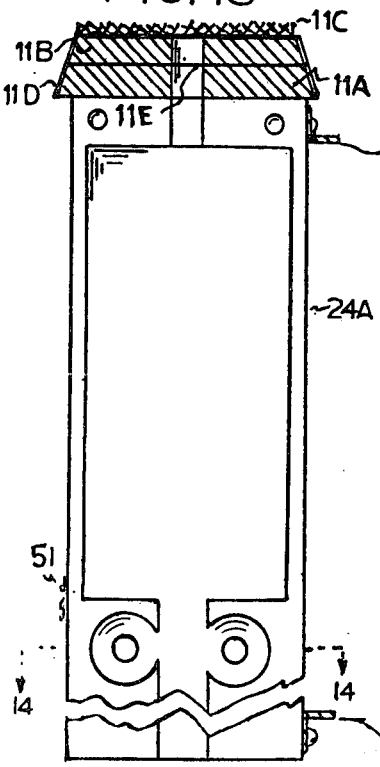
FIG. 13 is an elevation view of the interior of the back half of the lift rack.

FIG. 13 is a cross-sectional elevation view of the rear half 24A of the rack 24, taken on the line 13—13 of FIG. 12. FIG. 14 is a cross-sectional view of the two halves joined together and taken on the line 14—14 of FIG. 13. And FIG. 15 is a cross-sectional elevation view of the interior of the front half 24B of the rack 24 taken on a line of 15—15 of FIG. 14.

The clutch 36 was mounted to the body of the rack 24 so as to align with the shaft of the left friction roller 47. Consequently, a counter clockwise rotation of the friction roller 47 raises the tee frame 48, FIG. 17, and a clockwise rotation lowers it. In other words, it coincides exactly with the rotation of the rack 24 drive.

Figure 15:
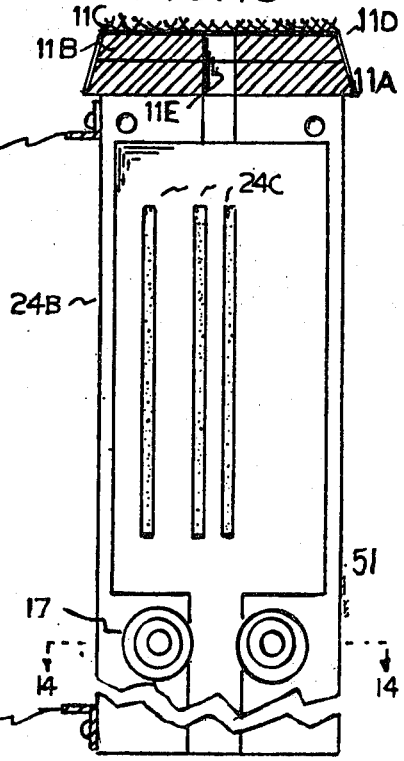
FIG. 15 is an elevation view of the interior of the front half of the lift rack taken on the line 15—15 of FIG. 14.
Figure 16:
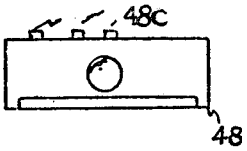
FIG. 16 is a top plan view of the tee and tee switch frame.

Inside the cavity of the front half 24B, FIG. 15, can be seen three additional wiper contacts 24C. These are to simply facilitate a continuity of electrical power to the tee switch 48A, FIG. 17, located inside the frame 48, as it moves up and down inside the rack 24. These wipers are connected to three electrical connections 52 located just above the clutch 36 on the outside of the rack 24 body, FIG. 8.

The filler disk 11, FIG. 13, permanently affixed to the top of the rack 24, consists of an aluminum base 11A, a rubber pad 11B, a simulated grass cover 11C, and a neoprene seal 11D, arranged in the configuration shown. In addition, there is a thin, flexible membrane 11E, stretched between the base 11A and the pad 11B, across the circular opening at the top of the rack 24. The membrane 11E also has an opening through which the tee 10 fits through. The membrane 11E fits fairly snugly around the circumference of the tee 10, but does not overly restrict the motion of the tee 10. The membrane 11E provides an additional moisture barrier for the further protection of the interior of the unit.

The tee 10 normally fits through the circular opening of the disk 11, through a similar opening in the top of the rack 24, and then into the tee frame 48, FIG. 21. The tee 10 itself is a semi-rigid, but flexible part, fabricated of a light steel spring imbedded in molded reinforced rubber, or other suitable substitute. It is very similar at the top to a standard golf tee, only thicker. The bottom half of the tee 10, however, is encased in a metal sheath threaded at the lower end. The top half of the tee 10 is designed to hold the ball in the proper position, and yet, be able to protect, and withstand the impact of the golf club. The bottom half assures a smooth motion during movement of the tee 10 through the rack 24.

The threaded portion of the tee 10 screws into a spring supported assembly 48B, FIG. 17, inside the frame 48. The assembly 48B is designed such that the tee 10 is free to move downward to actuate the spring-loaded up micro switch 48A when the weight of a ball depresses the tee 10. After the weight of the ball is removed, both the tee 10 and the actuator arm of the micro switch 48A return to their original positions. The spring supported arms of the assembly 48B are attached to pins at their lower ends. The upper ends are also attached with pins to the threaded female nut of the assembly, but the upper pins ride in small slots which are an integral part of the nut. The length of the slots restrict the downward motion of the tee 10 to only the very small amount necessary to actuate the switch. The springs themselves are also attached with pins; the upper end to the interior body of the tee frame 48 and the other end to the arms. These springs are very light and designed to support only the weight of the tee 10 itself. The entire assembly provides both a positive upward support, when the tee frame 48 moves up, and a positive pull down action, when the frame 48 is coming down. Thus, this assembly is to assure the tee 10 is always in the proper position by eliminating the possibility of the tee 10 sticking.

Figure 18:
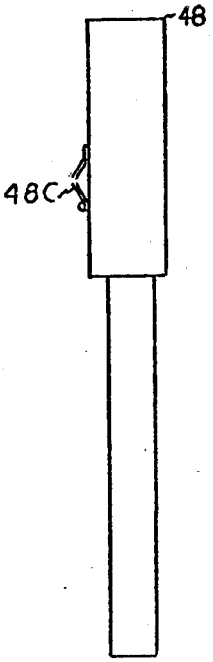
FIG. 18 is a side elevation view of the tee switch frame.
Figure 19:
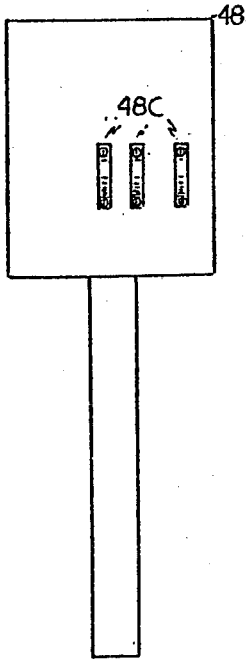
FIG. 19 is a front elevation view of the tee switch frame.

The sliding contacts 48C, FIGS. 18 and 19, normally ride in the channels provided for them in the interior of the rack 24, FIG. 15, at the bottom of which are the wiper contacts 24C. Pins of the micro switch 48A, FIG. 17, are wired to these sliding contacts thus electrical power is available to the switch irrespective of the position of the tee frame 48 inside the rack 24.

Figure 20:
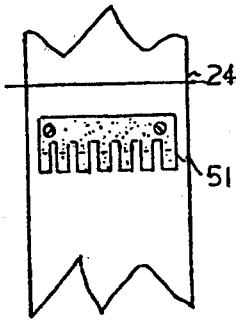
FIG. 20 is a fragmentary elevation view of the left side of the lift rack showing details of the sliding contacts.

FIG. 20 is simply a partial elevation view of the left side of the rack 24. This view displays the interconnected sliding contacts 51 discussed earlier.

FIG. 21 is an illustration of a cross section of the rack 24 with the tee frame 48 inside. In addition, there is a cutaway of the tee frame 48 to show the tee 10 attached to the pull down assembly 48B.

A basic schematic of the AC electrical circuitry of the preferred embodiment is provided as FIG. 22. To simplify and clarify the explanation, the various components are both labelled an numbered. The numbers correspond to those used in previous drawings. In addition, although possibly inappropriate on an AC schematic, arrows have been added to aid in tracing the circuits.

At the time shown, the master switch 54 has been turned "on" and the rotary switch 32 just moved to position four. The rack 24, FIG. 23, is still in the full up position depressing the up limit switch 37. Moving the rotary switch 32 from the "off" position, however, completed the circuit through the down side of the lift motor 17, through the down limit switch 38, through the tee switch 48A, and through the second section of the rotary switch 32, thus starting the rack 24 down. Since the rack 24 is above the second wiper 50, FIG. 10, and there is no golf ball on the tee switch 48A, the clutch 36 is not yet engaged and there is no power to either the ramp motor 16 or the up side of the lift motor 17. When the rack 24 does reach the point at which the slides 51, FIG. 20, come into contact with the second wiper of 50, the clutch 36 engages and the tee frame 48, FIG. 21, inside the rack 24 also starts down, if not already down. If the tee frame 48 is already down as a result of going to position four directly from the "off" position of the rotary switch 32, the friction rollers 47 simply rotate and exert a positive pull down action on the frame 48 until the rack 24 depresses the down limit switch 38 and cuts the power to the down side of the lift motor 17.

Since the down limit switch 38 is now depressed, but the tee switch 48A and up limit switch 37 are not, the circuit through the ramp motor 16 is now complete and, since the rack 24 is down and the rotary switch 32 is in an appropriate position, the circuit to the magnetic clutch 36 is also complete. Thus, the ramp motor 16 starts, driving the agitator 42, FIG. 6, and the ramp pulley assembly 39, FIG. 5, and the clutch 36 is engaged. After a ball drops from the hopper 12, FIG. 4, and is moved up the ramp 14 and onto the tee 10, thus depressing the tee switch 48A, the circuit to the ramp motor 16 is broken and the circuit to the up side of the reversible lift motor 17 is completed. The lift motor 17 then drives the rack 24 upward until the up limit switch 37 is actuated, where the circuit to the lift motor 17 is again broken, thus stopping the motor 17. On its motion upward, the interconnected slides 51, mounted on the rack 24, also broke contact at the terminus of the second wiper 50, thus breaking the circuit and disengaging the clutch 36. The top of the tee 10 was then exactly one half inch above the filler disk 11.

When the ball is hit, thus releasing the tee switch 48A, the circuit to the down side of the lift motor is again completed and the rack 24 moves down until the down limit switches 38 is again depressed. This action breaks the circuit to the lift motor 17 and again completes it to the ramp motor 16; starting the entire cycle over again. In addition, as the rack 24 moved downward, the clutch 36 was reengaged, at the appropriate point, and the tee 10 also was driven down to the position necessary to receive another ball.

With respect to the rotary switch 32, it should be noted that, with the exception of the "off" position, power is available to the remainder of the system irrespective of the position of the switch 32. Further, the "off" position is really a misnomer since it constitutes a tee switch 48A bypass. In the "off" position, the circuit is actually completed through the up side of the lift motor 17 thus driving the rack 24 up. The up limit switch 37 really serves as the cut-off switch. Naturally, the master switch 54 shuts off all power to the unit. As a consequence of the above, the rack 24 goes to a full up position and the tee 10 remains in a full down position when the rotary switch 32 is turned to "off." In this way, problems associated with dust and moisture are minimized. Except when in operation, the opening in the cover 5 is always filled; the tee 10, in a full down position, also serves much as a "cork in a bottle" for its particular opening; and the membrane 11E provides even further protection.

A "Power On" light 55 is also provided on the output terminals of master switch 54 to indicate power is available to the circuit. There is also an optional ball counting circuit which may be added, but is not shown here. In addition, there are several options with regard to the master switch 54. In commercial use, the master switch 54 may be one of several, controlling multiple units, and located on a remote panel inside an operations building; or, it may be a coin operated switch forming an integral part of the unit. In an uncontrolled environment, such as in private use, it is anticipated that a simple power switch would be employed. The switch would then be added to the control panel 31.

FIG. 23 is a partial view of the lift rack 24 and its lift mechanism designed primarily to show the entrainment of the belt 56 around the lift mechanism. pulleys, 57, 58 and 59 respectively. In addition, the uppermost and lowermost positions of the lift rack 24 are shown; the dashed lines representing the highest elevation and the solid lines the lowest. To avoid clutter and provide clarity, other components such as the ramp, ball guides, micro switches, etc., are not depicted. Also the front half of the support frame 19 and the elastic belt between magnetic clutch pulley 27 and the drive means have been removed. FIG. 3 equates to the same view with all components in their represented positions.

It should be recognized that design variations are possible. This particular design and configuration was chosen, however, because of its relative simplicity and lower costs. Both the cost of fabrication and maintenance should be comparatively low. Nevertheless, it may become necessary, in the interest of increased operational lifetimes and improved reliability, to change the size, shape, arrangement, or nature of several components. It is believed that these modifications may be accomplished without violating the basic principles and purpose of the present invention as defined by the following claims.

What is claimed is:

1. A golf ball teeing device, comprising:

a housing having an upper flat surface providing a tee area with an opening defined therein through which a golf ball can be raised from within said housing to a position for hitting by a golfer;

tee means having a portion for supporting a golf ball to be hit and movable substantially vertically from a lower most position within said housing to one of a plurality of selectable upper positions where a ball supported thereon will be disposed above said upper surface of said housing;

rack means supporting said tee means and having an upper surface substantially coextensive with said opening defined in said upper surface of said housing and surrounding said ball supporting portion of said tee means, said tee means being relatively movable within said rack means at a fixed rate relative thereto and substantially vertically between a lower most position at least as low as said lower most position of said tee means and an uppermost position in which said upper surface thereof is substantially in the plane of said upper surface of said housing;

ball supply means for supplying a ball to said tee means when it is in said lower most position;

reversible motor means mounted within said housing and selectively operable in either of two opposite directions upon receipt of an appropriate signal;

drive means coupling said motor means to said tee means and said rack means for causing said respective movements thereof; and means for sensing a ball has been removed from said tee means and thereupon supplying said appropriate signal to said motor means for causing downward movement of said tee means and said rack means, and for sensing when said ball supply means has placed a ball on said tee means and thereupon supplying said appropriate signal to said motor means for causing upward movement of said tee means and rack means.

2. A golf ball teeing device as defined in claim 1 wherein said drive means includes:

first drive means drivingly connecting said motor means to said rack means for causing said movement thereof;

second drive means drivingly connecting said motor means to said tee means for causing said movement thereof, said second drive means including clutch means operably connected between said motor means and said tee means for engaging and disengaging said motor means from said tee means at one of said plurality of selectable upper positions; and clutch control means selectably adjustable to cause said clutch to engage and disengage said motor means at a desired one of said selectable positions.

3. A golf ball teeing device as defined in claim 2 wherein said rack means includes:

a rack member supporting said upper surface of said rack means; and track means secured to said housing and supporting said rack member for guiding said vertical movement of said rack means.

4. A golf ball teeing device as defined in claim 3 wherein said tee means has a lower portion thereof extending into said rack member, said rack member having wall portions thereof for guidingly engaging said lower portion of said tee means for said vertical movement of said tee means.

5. A golf ball teeing device as defined in claim 4 and further including:

means supported by said rack member for said vertical movement therewith and engaging said lower portion of said tee means for causing said vertical movement thereof, said engaging means being operably connected to said clutch means which is also supported by said rack member for said vertical movement therewith.

6. A golf ball teeing device as defined in claim 5 wherein said second drive means includes a first pulley operably secured to said clutch means and a second pulley rotatably secured to said housing and driven by said motor means, and an expandable belt member supported by said pulleys for driving said clutch means.

7. A golf ball teeing device as defined in claim 6 wherein said clutch control means includes:

a plurality of electrically conductive strips secured to said track means extending vertically adjacent said rack member and having their uppermost edge portions terminating at different heights;

an electrically conductive contact member secured to said rack member in registry with said strips and engageable with said strips, said contact member being electrically connected to said clutch means;

a switch means for selectably supplying power to any one of said strips so that when said contact member is in engagement with a selected strip said clutch means will be engaged to move said tee means relative to said rack means to a respective one of said plurality of selectable positions.

* * * * *